US010400489B1

(12) United States Patent
Miller

(10) Patent No.: US 10,400,489 B1
(45) Date of Patent: Sep. 3, 2019

(54) SOUND-ACTIVATED REMOTE RELEASE ELECTRONIC DOOR STOP

(71) Applicant: Brian Douglas Miller, Anchorage, AK (US)

(72) Inventor: Brian Douglas Miller, Anchorage, AK (US)

( * ) Notice: Subject to any disclaimer, the term of this patent is extended or adjusted under 35 U.S.C. 154(b) by 0 days.

(21) Appl. No.: 16/053,184

(22) Filed: Aug. 2, 2018

(51) Int. Cl.
*G07C 9/00* (2006.01)
*E05C 17/44* (2006.01)
*E05C 17/48* (2006.01)

(52) U.S. Cl.
CPC ..... *E05C 17/44* (2013.01); *E05C 17/48* (2013.01); *G07C 9/00158* (2013.01); *E05Y 2400/32* (2013.01); *E05Y 2400/44* (2013.01); *E05Y 2400/852* (2013.01)

(58) Field of Classification Search
CPC . E05C 17/44; G07C 9/00174; E05Y 2400/32; E05Y 2400/322; A62C 2/24; E05F 3/222; E05F 1/006
USPC ..... 340/540
See application file for complete search history.

(56) References Cited

U.S. PATENT DOCUMENTS 3,150,894 A * 9/1964 Sant ..... E05B 47/0002 292/122
5,525,963 A * 6/1996 Purssey ..... A62C 2/24 292/92

FOREIGN PATENT DOCUMENTS

GB 2359335 A * 8/2001 ..... E05B 47/0002
WO WO-2012111921 A2 * 8/2012 ..... E05B 43/005

* cited by examiner

*Primary Examiner* — Emily C Terrell
(74) *Attorney, Agent, or Firm* — Plager Schack LLP; Mark H. Plager; Stephen Hallberg

(57) ABSTRACT

A remote-released door stop activated by specific sound is disclosed. With a remote detection device mounted on the door or elsewhere, a receiver can distinguish an alarm and release the door automatically to achieve closure for fire integrity and intruder prevention.

10 Claims, 3 Drawing Sheets

SOUND-ACTIVATED REMOTE RELEASE ELECTRONIC DOOR STOP

BACKGROUND

Embodiments of the invention described in this specification relate generally to door stops, and more particularly, to a sound-activated remote release electronic door stop.

As part of a fire-rated assembly, a door needs to remain shut during a fire to provide integrity in impeding fire and smoke passage. However, people often like to have doors left open or propped open. Thus, when desired, a door is propped open by means of any object that impedes the swing of the door (e.g., door stop, etc.). This presents a problem in terms of fire safety and other emergency situations because leaving the door open during an emergency event allows access to other rooms/areas. In particular, propping a door open allows fire and smoke to access other rooms/areas during a fire and allows intruders access to other rooms/areas during an intruder emergency.

While a person may be able to distinguish the sound of a fire alarm or other alarm and take appropriate action (closing the propped open door to prevent further access), there is no guarantee such a person will be anywhere near such a propped open door in time to close it. Furthermore, expecting a person to close any/all propped open doors limits and/or delays other important and significant actions that should reasonably be performed.

Therefore, what is needed is a remote detection device that gets mounted on a propped open door or elsewhere in the vicinity of a door, such that a receiver of the remote detection device can detect an alarm and release the door automatically to achieve closure for fire integrity and intruder prevention, and which includes separate channel detection for "silent-release" operation on a broadcast basis.

BRIEF DESCRIPTION

A novel sound-activated remote release electronic door stop that automatically detects a particular sound and closes a propped open door is disclosed. In some embodiments, the sound-activated remote release electronic door stop that automatically detects a particular sound and closes a propped open door is activated by an emergency alarm sound that a receiver of the sound-activated remote release electronic door stop can distinguish the emergency alarm sound from other sounds and release the door automatically to achieve closure for fire integrity and intruder prevention.

The preceding Summary is intended to serve as a brief introduction to some embodiments of the invention. It is not meant to be an introduction or overview of all inventive subject matter disclosed in this specification. The Detailed Description that follows and the Drawings that are referred to in the Detailed Description will further describe the embodiments described in the Summary as well as other embodiments. Accordingly, to understand all the embodiments described by this document, a full review of the Summary, Detailed Description, and Drawings is needed. Moreover, the claimed subject matters are not to be limited by the illustrative details in the Summary, Detailed Description, and Drawings, but rather are to be defined by the appended claims, because the claimed subject matter can be embodied in other specific forms without departing from the spirit of the subject matter.

BRIEF DESCRIPTION OF THE DRAWINGS

Having described the invention in general terms, reference is now made to the accompanying drawings, which are not necessarily drawn to scale, and wherein.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

Some embodiments of the invention include a novel sound-activated remote release electronic door stop that automatically detects a particular sound and closes a propped open door is disclosed. In some embodiments, the sound-activated remote release electronic door stop that automatically detects a particular sound and closes a propped open door is activated by an emergency alarm sound that a receiver of the sound-activated remote release electronic door stop can distinguish the emergency alarm sound from other sounds and release the door automatically to achieve closure for fire integrity and intruder prevention.

As stated above, as part of a fire-rated assembly, a door needs to remain shut during a fire to provide integrity in impeding fire and smoke passage. Embodiments of the sound-activated remote release electronic door stop described in this specification solve such problems by allowing the door to remain open by a person (or "user") while being able to detect a specific sound (i.e., a fire alarm) and automatically release the door stop to close the door upon fire alarm or other emergency alarm sound.

Embodiments of the sound-activated remote release electronic door stop described in this specification differ from and improve upon currently existing options. In particular, there are no automatic door release devices in existence which can detect a fire alarm and release a door that has been left open by a user. In fact, none of the conventional door stop devices are capable of detecting an event to release a door. In contrast, the sound-activated remote release electronic door stop of the present disclosure uses a remote detection device mounted on the propped open door or elsewhere, thereby allowing a receiver to distinguish a fire or emergency alarm sound from other sounds and identify the fire or emergency alarm sound as emanating from an alarm and release the door automatically to achieve closure for fire integrity and intruder prevention.

The sound-activated remote release electronic door stop of the present disclosure may be comprised of the following elements. This list of possible constituent elements is intended to be exemplary only and it is not intended that this list be used to limit the sound-activated remote release electronic door stop of the present application to just these elements. Persons having ordinary skill in the art relevant to the present disclosure may understand there to be equivalent elements that may be substituted within the present disclosure without changing the essential function or operation of the sound-activated remote release electronic door stop.

Figure 1:
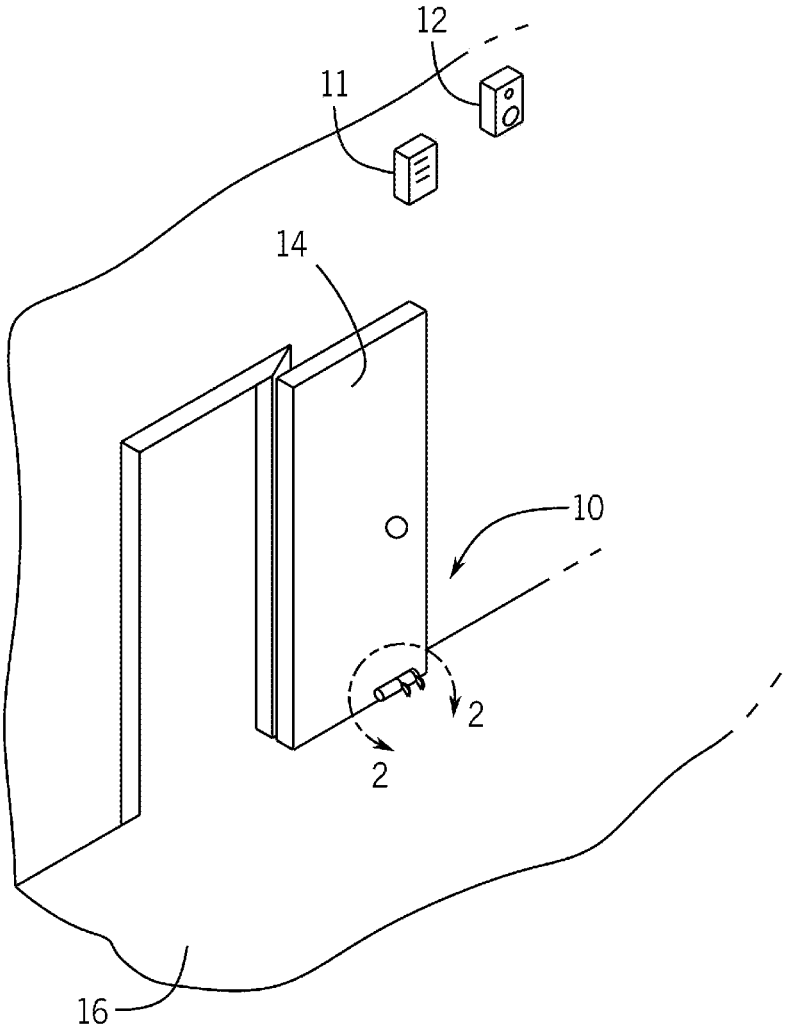
FIG. 1 conceptually illustrates a perspective view of a sound-activated remote release electronic door stop in some embodiments during use in connection with a propped open door.

1. Threaded cylinder body end cap
2. Extruded cylinder body
3. End cap contact spring
4. Space for D-Cell batteries (two each)
5. Negative circuit conductor
6. Positive circuit conductor
7. Component printed circuit board (PCB)
8. Potentiometer for a drive unit control
9. Micro-processor unit
10. Lithium battery cell holder
11. Drive capacitor-open
12. Drive capacitor-close
13. Drive unit
14. Main drive gear
15. Secondary drive gear
16. Engagement axle gear
17. Engagement axle shaft
18. Proximal engagement cog
19. Distal engagement cog
20. Sealed cylinder body end cap
21. Remote transceiver body
22. Microphone
23. Micro-processor unit
24. Manual test push button
25. Transistor Bank #1
26. Transistor Bank #2
27. Transistor Bank #3
28. Lithium battery cell holder
29. RGB LED indicator
30. Remote assembly cover
31. Adhesive cog floor patch The various elements of the sound-activated remote release electronic door stop of the present disclosure may be related in the following exemplary fashion. It is not intended to limit the scope or nature of the relationships between the various elements and the following examples are presented as illustrative examples only. By way of example, FIG. 1 conceptually illustrates a perspective view of a sound-activated remote release electronic door stop 10 during use in connection with a propped open door 14. In addition to the door 14, the sound-activated remote release electronic door stop 10 works in connection with an emergency alarm 11 and an electronic door stop alarm detector 12. As shown in this figure, the sound-activated remote release electronic door stop 10 is positioned on a floor 16 at the bottom of the door 14 and manages to keep the door 14 open until the electronic door stop alarm detector 12 detects an alarm sound from the emergency alarm 11.

Figure 2:
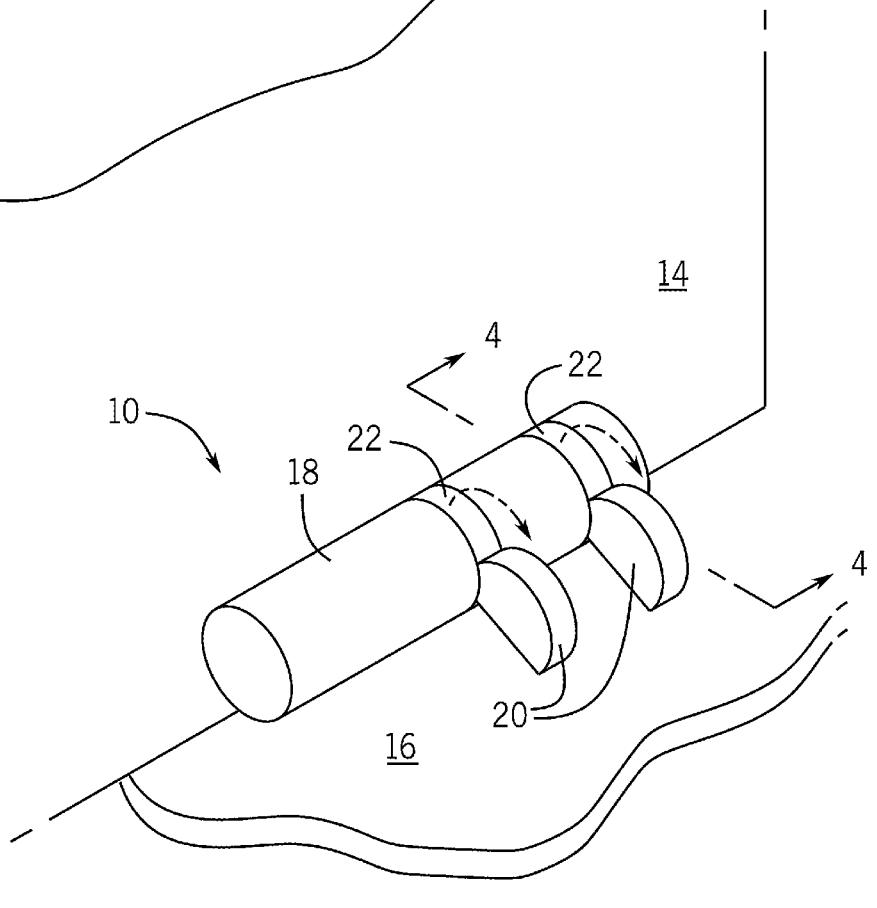
FIG. 2 conceptually illustrates a detailed perspective view of the sound-activated remote release electronic door stop at rest while propping the door open in some embodiments.

Turning to a more detailed example, FIG. 2 conceptually illustrates a detailed perspective view of the sound-activated remote release electronic door stop 10 at rest while propping the door 14 open. As shown in this detailed view, the sound-activated remote release electronic door stop 10 comprises a body 18, a pair of cogs 20, and a pair of slots 22 for the cogs 20. In some embodiments, the cogs 20 have a rounded semi-circle or crescent shape which allows for easy closing into and opening out of the pair of slots 22 (as shown in this figure by the dashed arc arrows). In some embodiments, the body 18 is a cylinder-shaped body for the rounded shape of the cogs 20 to fit snug inside the pair of slots 22 while closed. Thus, the sound-activated remote release electronic door stop 10 is able to prop the door 14 open by letting the cogs 20 out to touch the floor 16. When the door 14 applies pressure to close, the cogs 20 are pushed slightly downward into the floor 16 to prevent the door 14 from closing.

Figure 3:
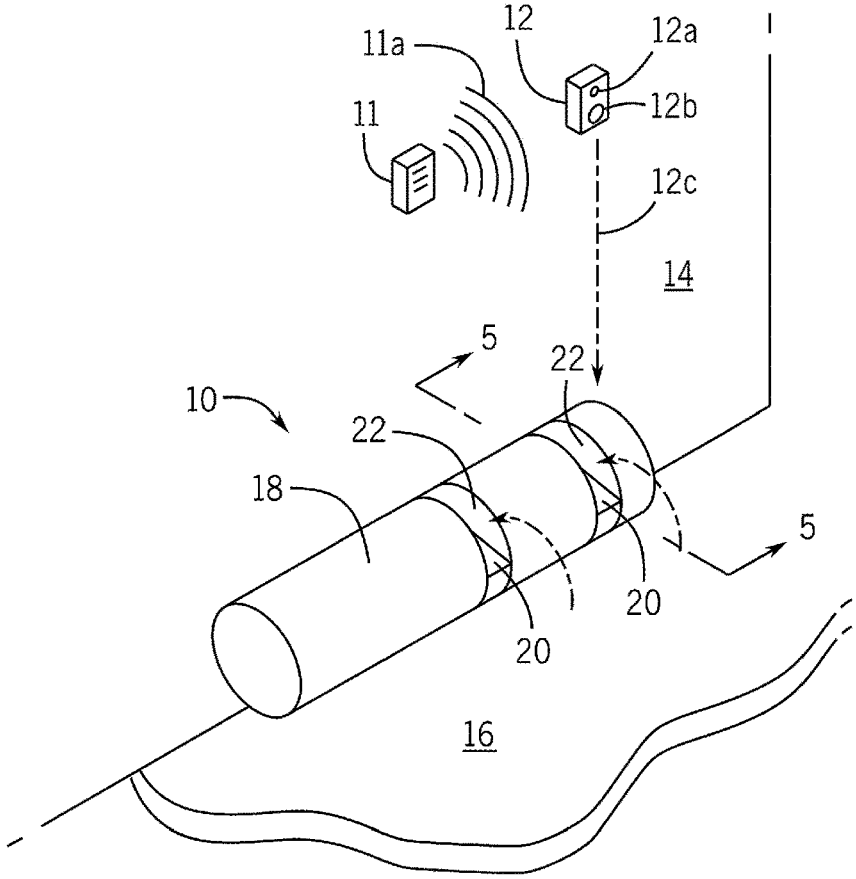
FIG. 3 conceptually illustrates a detailed perspective view of the sound-activated remote release electronic door stop while detecting an emergency alarm and automatically releasing the door stop to close the open door.

Releasing the sound-activated remote release electronic door stop 10 during an emergency (such as a fire) to close the door 14 is demonstrated in FIG. 3, which conceptually illustrates a detailed perspective view of the sound-activated remote release electronic door stop 10 while detecting an emergency alarm and automatically releasing the electronic door stop 10 to close the open door 14. As shown in this figure, when the emergency alarm 11 sounds an audible alarm warning 11*a* (e.g., a fire alarm), an electronic door stop alarm detector sensor 12*a* of the electronic door stop alarm detector 12 senses the sounding audible alarm warning (i.e., captures sound waves of the audible alarm warning). An electronic door stop alarm detector transmitter 12*b* then transmits an electronic door stop alarm detector signal 12*c* to the sound-activated remote release electronic door stop 10 positioned at the bottom of the door 14 near the floor 16. When the electronic door stop alarm detector signal 12*c* is received, the sound-activated remote release electronic door stop 10 automatically rotates the cogs 20 back into the cog slots 22 (shown by dashed-line arrows) within the body 18 of the sound-activated remote release electronic door stop 10, thereby freeing the door 14 to close.

Figure 4:
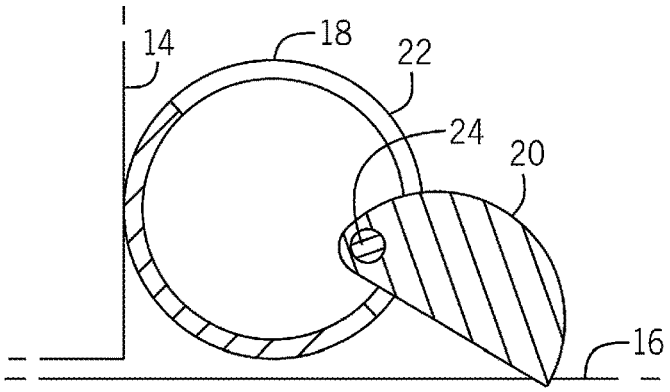
FIG. 4 conceptually illustrates a cross-sectional view of the sound-activated remote release electronic door stop taken along line 4-4 of FIG. 2 at rest and propping the door open.
Figure 5:
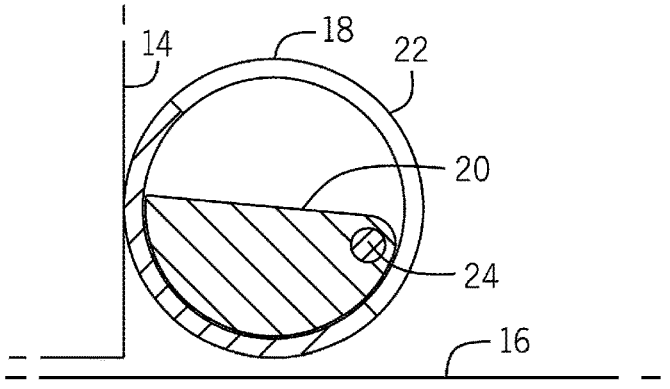
FIG. 5 conceptually illustrates a cross-sectional view of the sound-activated remote release electronic door stop taken along line 5-5 of FIG. 3.

By way of example, and referring to FIGS. 4 and 5, the opening and closing of the cogs 20 demonstrates how the sound-activated remote release electronic door stop 10 is able to prop the door 14 open in a safe way that ensures the door 14 automatically closes when an emergency alarm sounds. In particular, FIG. 4 conceptually illustrates a cross-sectional view of the sound-activated remote release electronic door stop 10 taken along line 4-4 of FIG. 2 at rest and propping the door 14 open. As shown in this figure, the cogs 20 touch the floor 16 in a fully open configuration to prop the door 14 open. An engagement axle shaft 24 (also referred to as pivot rod 24) resides in an extruded slot formed into the body 18 of the sound-activated remote release electronic door stop 10. At either end of the engagement axle shaft 24 (pivot rod 24) are affixed the cogs 20. The engagement axle shaft 24 holds the cogs 20 in position in relation to the body 18 and the cog slots 22 of the sound-activated remote release electronic door stop 10. While the engagement axle shaft 24 allows the cogs 20 to rotate into and out of the slots 22, the body 18 prevents the cogs 20 from rotating beyond a point at which engagement with the floor 16 is made.

By contrast, FIG. 5 conceptually illustrates a cross-sectional view of the sound-activated remote release electronic door stop 10, taken along line 5-5 of FIG. 3, in a fully closed configuration to release and close the door 14 in line with emergency requirements, such as fire safety. As shown in this figure, the cogs 20 rest inside the body 18 of the sound-activated remote release electronic door stop 10 by pivoting off the floor 16, via the engagement axle shaft 24, and into the cog slots 22. Thus, when the cogs 20 are off the floor 16 and resting inside the body 18, the sound-activated remote release electronic door stop 10 is cleared from the floor 16 (free space with no engagement with the floor 16), thereby allowing the door 14 to automatically close by its own pressure mechanism.

Figure 6:
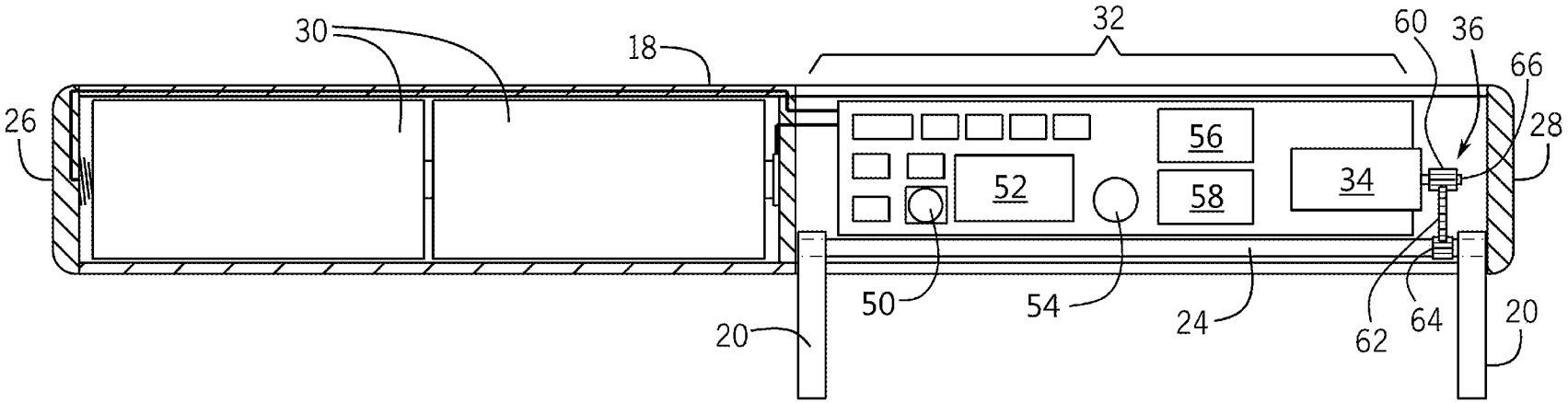
FIG. 6 conceptually illustrates a top plan view of the sound-activated remote release electronic door stop in some embodiments with parts shown in cross-section.

Now turning to another example, FIG. 6 conceptually illustrates a top plan view of the sound-activated remote release electronic door stop 10 with parts shown in cross-section. As shown in this figure, the sound-activated remote release electronic door stop 10 has a cylinder body 18 that houses several electrical and mechanical components. The cylinder body 18 is closed off at both ends by end caps, including a first end cap 26 and a second end cap 28. In some embodiments, the first end cap 26 is a removable threaded cylinder cap 26 where two batteries 30 are inserted and held in place as a battery stack. In some embodiments, the batteries are D-cell batteries. In some embodiments, the positive end of the battery stack contacts a positive circuit conductor inside the cylinder body 18, and a negative end of the battery stack contacts an end cap contact spring disposed to an inner side of the first end cap 26 and is affixed to a negative circuit conductor. The battery stack provides power to the sound-activated remote release electronic door stop 10 by way wires that connect the two circuit conductors to a first printed circuit board 32 (the first "PCB" 32). In some embodiments, the battery stack provides 5vdc to the first PCB 32 for operation of the sound-activated remote release electronic door stop 10. Mounted on the first PCB 32 are several components, including a potentiometer for drive unit control 50, a micro-processor for logic storage 52, a lithium battery cell holder 54 to provide back-up power at end-of-life, an OPEN capacitor 56 to provide power upon load, and a CLOSE capacitor 58 to provide power upon load. A drive unit 34 is securely fastened at the distal end of the first PCB 32. A gear train 36 extends off a drive unit shaft 66. The gear train 36 includes a main drive gear 60, a secondary drive gear 62, and an engagement axle gear 64. The main drive gear 60 extends directly off the drive unit shaft 66 and interfaces with a secondary drive gear 62. The secondary drive gear 62 meshes to the engagement axle gear 64 which is embossed into the engagement axle shaft 24 (pivot rod 24). The engagement axle shaft 24 resides in an extruded slot formed into the body 18 of the sound-activated remote release electronic door stop 10. The cogs 20 are disposed onto the two ends of the engagement axle shaft 24. Specifically, one cog 20 is affixed at the proximal end of the engagement axle shaft 24 and the other cog 20 is affixed at the distal end of the engagement axle shaft 24.

In some embodiments, a pair of adhesive floor patches are included with the entire packaged sound-activated remote release electronic door stop assembly, which will be affixed to solid-surface floors to provide a positive interface for the cogs of the sound-activated remote release electronic door stop to intercept and secure anchorage. In some embodiments, a desired standby function of the sound-activated remote release electronic door stop works by way of an EDS unit that is placed at a bottom location of an opened door, with the cogs deployed to interlock the door from closing via automatic door closer devices.

Figure 7:
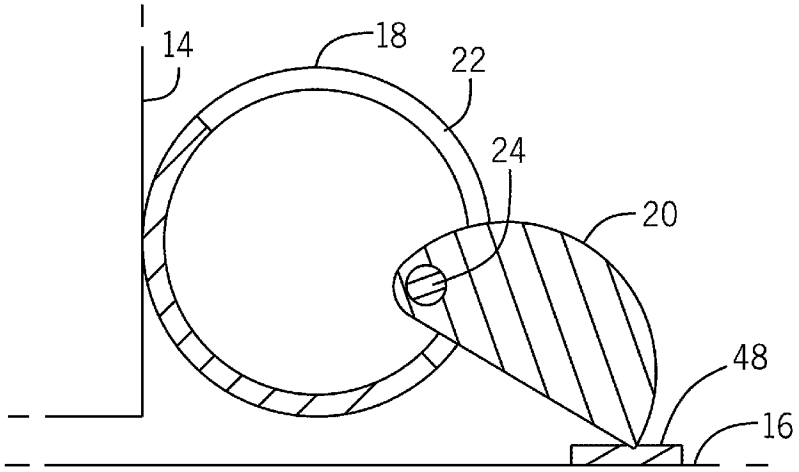
FIG. 7 conceptually illustrates a cross-sectional view of the sound-activated remote release electronic door stop with adhesive floor patch in some embodiments.

By way of example, FIG. 7 conceptually illustrates a cross-sectional view of the sound-activated remote release electronic door stop 10 with an exemplary adhesive floor patch 48 placed at a bottom location of an opened door 14 so that a cog 20 engages with the adhesive floor patch 48 when propping the door 14 open.

Figure 8:
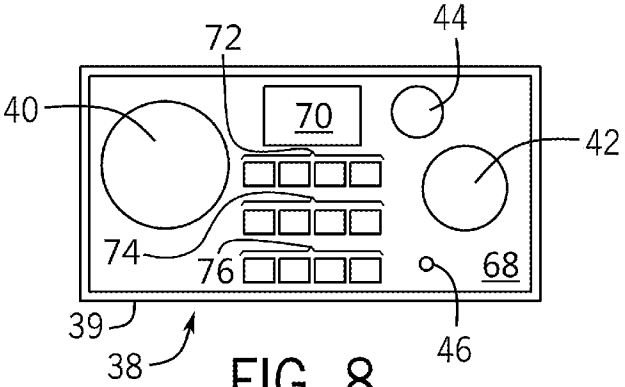
FIG. 8 conceptually illustrates a plan view of a printed circuit board of a sound-activated remote release electronic door stop in some embodiments.

In some embodiments, a desired active function of the sound-activated remote release electronic door stop 10 works by way of the remote transceiver and a remote transceiver printed circuit board, which detects a fire alarm siren, whistle, or klaxon pulse and issues a "Close" or "Release" signal to the sound-activated remote release electronic door stop. By way of example, FIG. 8 conceptually illustrates a plan view of a remote transceiver printed circuit board 38 of a sound-activated remote release electronic door stop 10. As shown in this figure, the remote transceiver printed circuit board 38 is a separate assembly comprising a printed circuit board 68 foundation. On the printed circuit board 68 is a pickup microphone 40, a microprocessor unit 70, a manual test button 42, a first transistor bank 72, second transistor bank 74, and a third transistor bank 76. All of these components are interconnected to the printed circuit board 68, and are powered by a lithium battery 44. An LED indicator 46) is positioned on the printed circuit board 68 to present operational status of the assembly, e.g., GREEN for ready, RED for active, and BLUE for fault. In some embodiments, the remote transceiver printed circuit board 38 is entirely protected by a cover housing 39 that snaps onto the printed circuit board 68 foundation.

In view of the examples described above by reference to FIGS. 1-8, then, a person would use the sound-activated remote release electronic door stop 10 with a door assembly that is equipped with an automatic closer. The door can be fully opened by the person, and then propped open by releasing the cogs from the cog slots of the sound-activated remote release electronic door stop 10. When the cogs 20 engage with the floor 16 or with adhesive floor patches 48 on the floor 16, the door 14 would be securely propped open, ready to be released when an alarm sounds. As the sound-activated remote release electronic door stop 10 is equipped with two D-cell batteries 30 and a lithium battery 44, there is ample power to operate the unit.

When ready for operation, the sound-activated remote release electronic door stop 10 can be commanded to OPEN status by the remote transceiver printed circuit board 38 operating in close proximity (e.g., within 20 lineal feet). The sound-activated remote release electronic door stop 10 will deploy the cogs 20 by rotating them on the engagement axle shaft 24 housed within the body 18. In some embodiments, the sound-activated remote release electronic door stop 10 can be affixed to the bottom of the door as a permanent fixture or semi-permanent installation. In some embodiments, the sound-activated remote release electronic door stop 10 can be used as desired, being added to the door when needed and removed when no longer in use. When the sound-activated remote release electronic door stop 10 is used as desired, the user will place body of the sound-activated remote release electronic door stop 10 at the base of the opened door, with the cogs 20 deployed. An alarm and remote detection unit should be present and nearby (as noted above, within about 20 lineal feet). During such usage, the two cogs 20 will engage the floor (carpeted or with adhesive patch) with a single tooth to prevent the sound-activated remote release electronic door stop 10 from rolling by the force of the door opener. In the case of smooth floor surface, the user will affix the adhesive floor patches 48 to the floor in alignment with the cogs 20 to provide for a positive interface between the floor and the cogs 20. In this state, the sound-activated remote release electronic door stop 10 remains in place for as long as desired by the user, and the door is held open.

In the event of a fire alarm, the remote transceiver printed circuit board 38 picks up the harmonic sound vibrations with the pickup microphone 40 and compares to the data stored in the microprocessor unit 70. If the sound resembles the prescribed parameters of an alarm state, the microprocessor unit 70 broadcast the ACTIVE command signal. The sound-activated remote release electronic door stop 10 receives the signal via the first printed circuit board 32 and the signal is then interpreted by the microprocessor unit 70. Upon confirmation of the signal parameters, the microprocessor unit 70 closes the circuitry to the close capacitor 58, the potentiometer 50, and the drive unit 34. The drive unit 34 is powered positively to turn the main drive gear 60, which interfaces to the secondary drive gear 62, which interfaces to the engagement axle gear 64 thereby rotating the engagement axle shaft 24 in such fashion to retract the two engagement cogs 20.

In some embodiments, the body 18 of the sound-activated remote release electronic door stop 10 presents as a smooth round cylinder which poses no resistance for the automatic door closer to operate. Thus, when the door begins to swing closed, the sound-activated remote release electronic door stop 10 rolls along at the bottom. The door continues to roll toward complete closure, while rolling the sound-activated remote release electronic door stop 10 out of the way. The action completes with the door swinging completely closed, fully-engaging with the door hardware to provide a locked or unlocked condition as predetermined by the user of the space.

In some embodiments, the sound-activated remote release electronic door stop 10 utilizes a two-tiered power source. Primary power, as provided by the D-cell batteries 30, is first sampled, and if adequate within set parameters, then the sound-activated remote release electronic door stop 10 is configured for operation. When the primary power (as sampled) is not adequate or becomes inadequate due to prolonged use, then the sound-activated remote release electronic door stop 10 is integrally de-activated and the cogs 20 will not extend. If they were already engaged to the floor in an extended position, then a secondary power (of the two-tiered power source) is supplied by the lithium battery 44 cell, thereby allowing the sound-activated remote release electronic door stop 10 to retract the cogs.

In some embodiments, a signal transmits from remote sensor to main unit, and micro-processor begins sub-routine for cog deployment. The drive unit is energized for a set period of time, and the cogs 20 rotate out of the slots 22 of the cylinder body 18. The potentiometer 50 allows for speed adjustment factory-settings. Upon time-out, the processor closes sub-routine. The cogs 20 are held in position by drive unit resistance.

To make the sound-activated remote release electronic door stop 10 of the present disclosure, the cylinder body may be manufactured by an extrusion process in which the extruded body would have slots inside the body for placement of various components during later assembly. After the extrusion process, the body would be precisely cut at two locations to fashion slots for the engagement cogs to extend through. The cylinder body would have an enlarged receiver recessed into the body at one of the body (e.g., having size of 0.125") to tightly fit to the sealed cylinder body end cap (i.e., the first end cap 26) after component assembly, while the other end of the body would be internally threaded (e.g., having size of 0.375") to receive the threaded cylinder body end cap (i.e., the second end cap 28) after complete device assembly.

The component printed circuit board (i.e., the first printed circuit board 32) may be manufactured as a complete assembly with all the assembly components permanently residing on it (i.e., the potentiometer for drive unit control 50, the micro-processor for logic storage 52, the lithium battery cell holder 54 to provide back-up power at end-of-life when D-cell battery power is drained, the OPEN capacitor 56, the CLOSE capacitor 58, and the drive unit 34). This sub-assembly may be manufactured separately as a completed device designed specifically for the sound-activated remote release electronic door stop 10, and would be fully inserted into the designated slots inside the cylinder body 18 from the end of the body 18 that is covered by the second threaded end cap 28. A negative circuit conductor is a rigid bus component that may be inserted from the end of the body 18 that is covered by the first threaded end cap 26.

Additional circuitry and logic may be included to supplement the original detection and operation of an emergency event. For example, a different frequency reception may be incorporated to command the device to operate similarly but as a result of a completely different protocol. Instead of detection and operation during a fire alarm event, a separate frequency detection could operate the device as result of an intrusion detection, an active-shooter event, or other crowd-control measures. Furthermore, the internal devices may be rearranged in differing positions relative to each other within the housing assembly. The engagement cogs may take different shapes, but with the intent to make a positive and resistive engagement to the adjacent floor is requisite.

To use the sound-activated remote release electronic door stop 10 of the present disclosure, a person may install two D-cell batteries 30 through the end of the body 18 covered by the first end cap 26. After new battery insertion, an occupant of a room or space equipped with a self-closing door would active the sound-activated remote release electronic door stop 10 to extend the engagement cogs 20 out of the body 18 housing through the cog slots 22. Then, the sound-activated remote release electronic door stop 10 would be placed at the interface of the open door 14 relative to the floor 16 in such a fashion as to prop the door 14 open by engagement of the cogs 20 with the floor 16. If the floor 16 is a hard or slippery surface, placement of the optional adhesive patch 48 onto the cleaned floor would provide a positive engagement surface for the cogs 20 to resist the door-closing pressure. The second piece of the sound-activated remote release electronic door stop 10 assembly is the remote receiver (i.e., the remote transceiver printed circuit board 38), which the person may activate with a new power cell. The person would place the remote receiver adjacent to and within approximately ten-twenty feet of the door frame. A simple test-cycle of the receiver would confirm the receipt of a release signal from the receiver to the sound-activated remote release electronic door stop 10, resulting in the door self-closing as designed.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

I claim:

1. A sound-activated remote release electronic door stop that is triggered by an alarm sound to release a propped open door during an emergency, said sound-activated remote release electronic door stop comprising:

an electronic door stop placed at a bottom of the door near a floor and configured to prop the door open when activated, said electronic door stop comprising a body, a pair of slots cut out from a surface of the body, and a pair of engagement cogs configured to open when activated and close when an alarm detector signal is received; and a remote receiver comprising (i) an alarm detector sensor configured to detect a specific audible alarm sound and (ii) an alarm detector transmitter configured to transmit an alarm detector signal to the electronic door stop when the alarm detector sensor detects the specific audible alarm sound.

2. The sound-activated remote release electronic door stop of claim 1, wherein the pair of engagement cogs open by rotating out of the body through the pair of slots and engaging with the floor to prop the door open.

3. The sound-activated remote release electronic door stop of claim 2, further comprising a pair of adhesive patches that are placed on the floor at positions at which the pair of engagement cogs engage with the floor to prop the door open.

4. The sound-activated remote release electronic door stop of claim 2, wherein the pair of engagement cogs close by rotating back into the body through the pair of slots to release the open door.

5. The sound-activated remote release electronic door stop of claim 1, wherein the body of the electronic door stop comprises a cylinder body that rolls on the floor when the alarm detector signal is received and the pair of engagement cogs are closed.

6. The sound-activated remote release electronic door stop of claim 1, wherein the specific audible alarm sound comprises a fire alarm warning sound.

7. The sound-activated remote release electronic door stop of claim 1, wherein the electronic door stop further comprises an engagement axle shaft that resides in a slot formed into the body.

8. The sound-activated remote release electronic door stop of claim 7, wherein the pair of engagement cogs are affixed at either end of the engagement axle shaft.

9. The sound-activated remote release electronic door stop of claim 7, wherein the electronic door stop further comprises a first printed circuit board ("PCB"), a drive unit securely fastened at a distal end of the first PCB, a drive unit shaft, a gear train that extends off the drive unit shaft and meshes to the engagement axle gear, and a battery power source that resides in a battery slot formed into the body and provides electric current to power the first PCB and the drive unit.

10. The sound-activated remote release electronic door stop of claim 9, wherein first PCB starts the drive unit when the alarm detector signal is received, wherein the gear train rotates the engagement axle shaft when the drive unit is started, wherein the engagement cogs rotate when the engagement axle shaft rotates.

* * * * *